US008696376B2

(12) United States Patent
Andresen et al.

(10) Patent No.: US 8,696,376 B2
(45) Date of Patent: Apr. 15, 2014

(54) CABLE CONNECTION SYSTEM AND METHOD FOR CONNECTING A CABLE TO A CABLE CONNECTION SYSTEM

(75) Inventors: Jens Andresen, Blomberg (DE); Jens Gerullis, Lemgo (DE)

(73) Assignee: Phoenix Contact GmbH & Co. KG, Blomberg (DE)

( * ) Notice: Subject to any disclaimer, the term of this patent is extended or adjusted under 35 U.S.C. 154(b) by 0 days.

(21) Appl. No.: 13/638,086

(22) PCT Filed: Jun. 6, 2011

(86) PCT No.: PCT/EP2011/059315

§ 371 (c)(1),
(2), (4) Date: Sep. 28, 2012

(87) PCT Pub. No.: WO2011/154367

PCT Pub. Date: Dec. 15, 2011

(65) Prior Publication Data

US 2013/0023146 A1 Jan. 24, 2013

(30) Foreign Application Priority Data

Jun. 7, 2010 (DE) ..... 10 2010 017 265

(51) Int. Cl.
*H01R 4/24* (2006.01)

(52) U.S. Cl.
USPC ..... 439/391

(58) Field of Classification Search
USPC ..... 439/391, 406
See application file for complete search history.

(56) References Cited

U.S. PATENT DOCUMENTS

| | | | | |
|---|---|---|---|---|
| 3,851,296 | A * | 11/1974 | Muchmore et al. | 439/372 |
| 4,256,935 | A * | 3/1981 | Ito et al. | 200/51 R |
| 5,151,053 | A | 9/1992 | Shinji | |
| 5,348,487 | A * | 9/1994 | Marazzi et al. | 439/138 |
| 5,491,766 | A * | 2/1996 | Huynh et al. | 439/98 |
| 8,226,431 | B2 * | 7/2012 | Reimchen | 439/459 |
| 2003/0194890 | A1 | 10/2003 | Ferderer | |
| 2005/0118870 | A1 | 6/2005 | Schreier | |

FOREIGN PATENT DOCUMENTS

| | | |
|---|---|---|
| DE | 92 04 291 | 5/1992 |
| DE | 10216483 | 11/2003 |
| DE | 202008004892 | 7/2008 |
| DE | 10 2008 019764 | 10/2009 |
| DE | 20 2009 013522 | 12/2009 |

(Continued)

OTHER PUBLICATIONS

International Search Report issued in PCT/EP2011/059315 on Sep. 20, 2011.

(Continued)

*Primary Examiner* — Briggitte R Hammond
(74) *Attorney, Agent, or Firm* — DLA Piper LLP (US)

(57) ABSTRACT

The invention relates to a cable connection system, in particular a cable connection plug, comprising a guide device, a cap nut adapted to be screwed onto a connection part comprising at least one connection element and at least one insulation displacement connector, wherein the guide device comprises a cable receiving part for receiving and clamping an end region of a cable comprising at least one wire and a wire guide part for guiding the wire by means of at least one wire guide structure. The invention also relates to a method for connecting a shielded cable to a cable connection system of this kind.

9 Claims, 3 Drawing Sheets

(56) References Cited

FOREIGN PATENT DOCUMENTS

| | | | |
|---|---|---|---|
| DE | 10 2010 008845 | | 2/2011 |
| JP | 03-126374 | | 5/1991 |
| JP | 03126374 | U * | 12/1991 |

OTHER PUBLICATIONS

International Preliminary Report on Patentability and Written Opinion issued in PCT/EP2011/059315 on Dec. 10, 2012.

English Language Abstract of DE 10 2008 019764 published Oct. 22, 2009.

English Language Abstract of DE 10 2010 008845 published Feb. 24, 2011.

English Language Abstract of DE 10216483 published on Nov. 20, 2003.

Office Action dated Jan. 24, 2014, received in Japanese counterpart application No. 2013-513657 (JP2013-531454A).

* cited by examiner

CABLE CONNECTION SYSTEM AND METHOD FOR CONNECTING A CABLE TO A CABLE CONNECTION SYSTEM

CROSS REFERENCE TO RELATED APPLICATIONS

This application is a U.S. National Stage Application of International Application No. PCT/EP2011/059315 filed Jun. 6, 2011. International Application No. PCT/EP2011/059315 claims priority from German Patent Application No. 10 2010 017 265 filed Jun. 7, 2010. The entirety of all of the above-listed Applications are incorporated herein by reference.

The invention relates to a cable connection system, in particular to a cable connection plug, comprising a guide means and a cap nut adapted to be screwed onto a connection part comprising at least one connection element and at least one insulation displacement connector, wherein the guide means comprises a cable receiving part for receiving and clamping an end region of a cable which comprises at least one wire and a wire guide part for guiding the wire by means of at least one wire guide structure, wherein when the cap nut which overlaps the guide means is screwed onto the connection part the end region of the cable is clamped within the cable receiving part and a wire insulation of the wire guided in the guide means is cut through by the insulation displacement connector. The invention further relates to a method of connecting a cable to a cable connection system.

From DE 199 51 455 C1 a cable connection system is known by which the wires of a cable can be connected in an easy way to the connection elements of an appliance connection member or a cable connection member without the need for removing the wire insulations of the individual wires. To this end the cable connection system comprises a guide means and a cap nut adapted to be screwed onto the appliance connection member or cable connection member comprising at least one insulation displacement connector. The guide means itself comprises a cable receiving part for receiving and clamping an end region of a cable and a wire guide part for guiding the corresponding wires by means of a wire guide structure. When the cap nut overlapping the guide means is screwed onto the appliance connection or cable connection member the end region of the cable is clamped within the cable receiving member and the wire insulation of the wires guided in the guide means is cut through by insulation displacement connectors of the appliance connection or cable connection member.

In the meantime this kind of cables is also used in the application field of data transmission, wherein the cables in this application field are formed as shielded cables.

Cable connection systems formed as plug connectors for shielded cables comprising a shielding and a shielding connection part for connecting the shielding of the plug connector to the shielding of the cable are also known. DE 20 2008 004892 U1 shows a shielding connection element which can also be used in a cable connection system as previously described for connecting the shielding of the shielded cable electrically conductive by means of an electrically conductive cap nut of the cable connection system and the connection part. To this end said shielding connection element has a pan like shape comprising a bottom and an angled collar by which the exposed shielding of the cable is guided outwardly such that, when the cap nut is screwed onto the male thread of the corresponding connection part, the collar with the shielding electrically comes into contact with the conductive cap nut and the connection part. For transferring the shielding effect of the shielding it is necessary for this shielding connection element that the connection part onto which the cap nut is screwed is made of an electrically conductive material. Moreover the corresponding plug connector is relative complex with regard to its component circumference and the handling of this shielding connection element (the shielding transfer element).

Thus it is an object of the invention to provide a cable connection system and a corresponding method for connecting a cable to such a cable connection system which enable an easy connection of a shielded cable, wherein the constructive structure of the cable connection system is relative simple.

This object is achieved according to the invention by the features of the independent claims. Preferred embodiments of the invention are specified in the dependent claims.

In the cable connection system according to the present invention it is provided that the guide means comprises a shielding connection part disposed in a connection area between the cable receiving part and the wire guiding part for resiliently receiving and electrically contacting a shielding of the cable at its end region by means of at least one spring element. When the cap nut is screwed on the plugged-in end region of the cable is fixed in the plugged-in position within the cable receiving part. Thus the shielding connection part has not to ensure the fixation of the shielding of the cable but merely has to provide for a permanent and secure electrical contact. The cable receiving part together with a sealing plugged into this receiving part is particularly formed as strain relief and sealing part of the cable connection system and thus forms a cable receiving and clamping part.

Advantageously it is provided that the cable receiving part and the wire guide part are connected to each other and in combination have an essentially hollow cylindrical overall shape. Herein the shielding connection part is disposed at the inside of the overall shape. In particular the cable receiving part and the wire guide part are connected integrally.

According to a preferred embodiment of the invention it is provided that the shielding connection part is electrically connected or electrically connectable to a shielding means of the cable connection system. Thus the shielding connection part is electrically connected or electrically connectable to the shielding means of the cable connection system internally of the cable connection system. Thus a simple force-fit and/or form-fit connection of the shielding of the plugged-in cable to the shielding connection part is sufficient in order to ensure a gapless shielding between the cable and the cable connection system.

According to a further preferred embodiment of the invention it is provided that the shielding connection part is formed as a funnel-shaped catch means comprising an annular base and spring elements extending obliquely from this base toward the symmetry axis of the funnel shape. This catch means is aligned with the plug-in direction of the end region of the cable into the cable receiving part, wherein the funnel-like tapering shape of the catch means extends in the plug-in direction. Thus the annular base faces the cable receiving part and the opening at the end opposite to the catch means faces the wire guide part. Herein the spring elements are not flush with each other such that gaps can remain between the individual spring elements.

In particular the opening of the catch means has a diameter at the base which is larger than the diameter of the opening of the catch means at the opposite end. It is particularly preferred that the opening of the base has a diameter which is larger than that of the cable and the opening at the opposite end has a diameter which is smaller than the diameter of the cable.

According to these proportions it is ensured that the end region of the cable comprising the shielding can easily be threaded into the catch means and the shielding can actually be catched in the catch means. In particular it is provided that the diameter of the opening at the base is at least 20% larger than the diameter of the cable and the diameter of the cable in turn is at least 20% larger than the opening at the opposite end of the catch means.

According to a further preferred embodiment of the invention it is provided that each of the spring elements comprises an end region angled outwardly at its end opposite to the base. This angled end region is supported at the inner face of the hollow cylindrical overall shape when the spring elements are spread at the maximum. Due to the length of this end region and the corresponding angle with respect to the remaining spring element a maximum diameter of the opening is defined at the end opposite to the base.

According to a further preferred embodiment of the invention it is provided that the shielding connection part—in particular for its connection to the shielding means—comprises at least one conductor element. If the shielding connection part is configured as a catch means comprising an annular base and obliquely extending spring elements the conductor element is in particular disposed at one of the spring elements and/or the base.

It is particularly provided that the conductor element extends through the or one of the wire guide structure(s) and comes into contact with an insulation displacement connector associated thereto, when the cable connection system is assembled. Thus, the conductor element is treated like one of the wires of the cable and can be connected electrically to an associated connection element of the connection part.

According to a further preferred embodiment of the invention it is provided that the cable receiving part, the wire guide part and the shielding connection part are connected to each other by means of a catch mechanism. Alternatively these components of the guide means can be connected with each other in another way.

It is preferably provided that the shielding means is formed of or at least partially formed of the cap nut and a connection body of the connection part. To this end the cap nut and the connection body are preferably made of metal.

According to a further embodiment of the invention it is finally provided that the cable connection system comprises the connection part, too. The connection part preferably comprises a number of insulation displacement connectors corresponding to the number of wire guide structures and further comprises at least one connection element electrically connected to an associated insulation displacement connector. This connection element, for example, can be a plug or a socket element but also a conductor element of a line.

The invention further relates to a method of connecting a cable comprising a shielding and at least one wire to an abovementioned cable connection system, wherein the method includes the following steps: (a) pulling the shielding in the end region of the cable over its cable insulation, (b) inserting the wires up to a stop of the cable insulation through the cable receiving part into the shielding connection part, (c) laying the wires into the guide structure and (d) assembling the guide means and the connection element by screwing on the cap nut overlapping the guide means, wherein the end region of the cable is clamped within the cable receiving part and the wire insulation of the at least one wire is cut through by an associated insulation displacement connector of the connection element and the conductor of the wire is contacted.

In the method of the invention it is particularly provided that also the conductor element of the shielding connection part is laid into a guide structure and electrically comes into contact with an associated insulation displacement connector after assembling the guide means and the connection element.

In the following the invention is described in detail with respect to the accompanying drawings based on preferred embodiments; in which.

Figure 1:
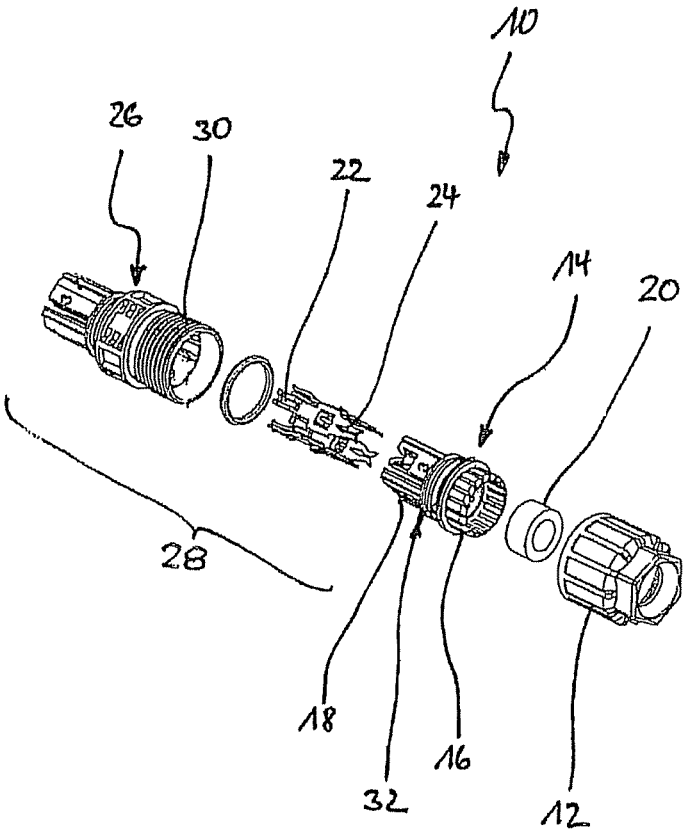
FIG. 1 shows a perspective exploded view of a cable connection system comprising a guide means, a cap nut and a connection part according to a preferred embodiment of the invention.

FIG. 1 shows an exploded view of a cable connection system 10 formed as a cable connection plug. The cable connection system 10 primarily includes a cap nut 12, a guide means 14 comprising a cable receiving part 16 and a wire guide part 18, an annular sealing 20 adapted to be laid into the cable receiving part 16 of the guide means 14, four connection elements 22 which are each connected to an insulation displacement connector 24 at their side facing to the cable to be connected (not shown) and the guide means 14 and a connection body 26 which together with the connection elements 22 disposed in the connection body 26 and insulation displacement connectors 24 forms a connection part 28. The connection body 26 comprises a male thread 30 corresponding to a not shown female thread of the cap nut 12. Within a connection region 32 inside the essentially hollow cylindrical guide means 14 there is provided a shielding connection part 34 shown in FIGS. 2 and 3 for receiving an end region of the cable and for electrically contacting a shielding of the cable in said end region of the cable. The wire guide part 18 comprises four wire guide structures 36 for guiding and aligning the wire ends of the wires before the guide means 14 and the connection part 28 are assembled.

Figure 2:
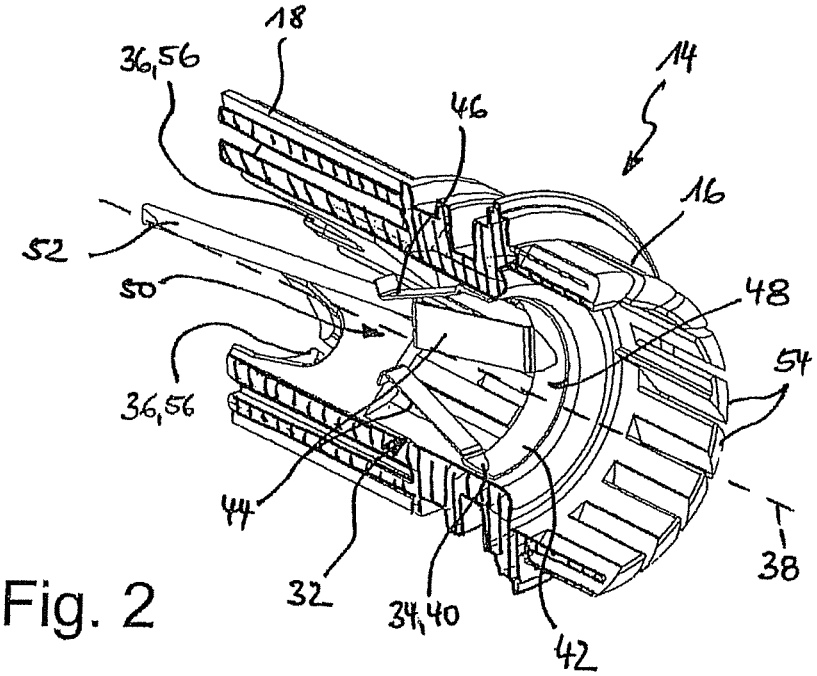
FIG. 2 shows a perspective sectional view of the guide means of FIG. 1 and a shielding connection part disposed therein according to a preferred embodiment of the invention.

FIG. 2 shows a sectional view of the guide means 14. The guide means 14, as mentioned above, with respect to the longitudinal direction (longitudinal axis 38) consists of the cable receiving part 16 and the wire guide part 18 extending therefrom via the connection region 32. Herein the guide means 14 is essentially formed as a hollow cylinder in the longitudinal direction, i.e. along the longitudinal axis 38. Inside this hollow cylinder the shielding connection part 34 formed as a funnel-like catch means 40 is disposed within the connection region 32 between the cable receiving part 16 and the wire guide part 18. The funnel-like catch means 40 consists of an annular base 42 and four spring elements 44 which extend obliquely from said base 42 toward the symmetry axis of the funnel shape which matches with the longitudinal axis 38 of the guide means 14, wherein, however, due to the sectional view only three spring elements can be seen. Herein the spring elements 44 in the specific embodiment shown are resilient lags welded to the annular base 42. Each of the spring elements 44 comprises an outwardly angled end region at its end 46 opposite to the base 42.

Thus there are formed two openings 48, 50 of the catch means 40. The opening 48 at the base has a diameter which is larger than that of a cable (not shown) associated to the cable connection system 10, and the opening 50 formed at the opposite end 46 has a diameter which is smaller than that of the cable. The shielding connection part 34 further comprises a conductor element 52. This conductor element 52 is attached to one of the spring elements 44 at the shielding connection part 34 formed as a catch means 40 and extends as an elongation of said spring element 44.

The cable receiving part 16 comprises a plurality of circumferentially disposed fins 54 at the inner side of which the sealing 20 shown in FIG. 1 can abut. The fins 54 cooperate with a bevel provided at the inner side of the cap nut 12 as a so-called PG gland such that when the cap nut 12 is screwed onto the connection part 28 the fins 54 are pressed against the sealing 20 whereby a sealing towards the end region of the cable is provided. At the same time this structure acts as a strain relief of the cable.

Moreover within the wire guide part 18 of the guide means 14 wire guide structures 36 are provided at the outer side in a number which corresponds to the number of wires to be connected and the number of connection elements 22 of the connection part 28. The wire guide structures 36 are formed as recesses 56. These recesses 56 are a kind of catch and positioning structures for the corresponding wires of the cable and the conductor element 52 of the shielding connection part 34, respectively.

Figure 3:
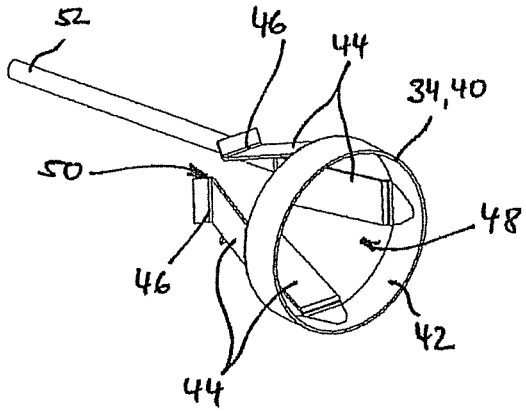
FIG. 3 shows a perspective view of the complete shielding connection part of FIG. 2.

FIG. 3 shows the complete shielding connection part 34 formed as a catch means 40 comprising an annular base 42, the spring elements 44 and the conductor element 52.

Thus the following function of the wire guide part 18 is achieved: if the end region of the cable is inserted into the cable receiving part 16 the wires of the cable extend through the shielding connection part 34 formed as a funnel-shaped catch means 40 and enter the wire guide part 18 of the guide means 14. There the wires and optionally also the conductor element 52 of the shielding connection part 34 are bent radially outwardly and laid into the guide structures 36 formed as recesses 56. Herein the recesses 56 serve as retaining locks for the wire ends and the end of the conductor element 52.

Because in this configuration the wire ends and the end of the conductor element 52, respectively, intersect the insulation displacement connectors 24 of the connection part 28 shown in FIG. 1 the wire insulation and the insulation of the conductor element 52, respectively, if provided, are incised when the cap nut 12 is screwed onto the connection part 28 and subsequently the insulation displacement connectors 24 come into contact with the conductor of the wires and the conductor element 52, respectively.

Furthermore the following function of the shielding connection part 34 formed as a catch means 40 is achieved: by means of the gaps between the individual spring elements 44 the individual wires of the cable can extend through the catch means 40 without any difficulty. However, the shielding of the cable pulled over the cable insulation and formed as a shielding mesh cannot extend through the catch means 40 because the second opening 50 at the end 46 opposite to the base 42 has a diameter which is smaller than that of the cable including its insulation. Thus there is provided a stop up to which the cable and the cable insulation can be inserted through the cable receiving part 16 into the shielding connection part 34. Due to the spring effect of the spring elements 44 and the guide bevel thus formed there is provided a force-fit and/or form-fit between the shielding of the cable and these spring elements 44. If the end region of the cable is now clamped within the cable receiving part 16 by means of the sealing 20 a permanent electrical connection between the shielding of the cable and the shielding connection part 34 is created. This can be connected electrically through the conductor element 52 and the corresponding insulation displacement connector 24 to a connection element 22 which is in electrical contact with said insulation displacement connector. Alternatively or additionally contacting can also be achieved over a further path.

In order to connect a cable comprising a shielding to the cable connecting system 10 the following five steps are conducted:

(i) removing an end piece of the cable insulation in the end region of the cable;

(ii) pulling the shielding in the end region of the cable over its remaining cable insulation;)

(iii) inserting the end region of the cable up to a stop of the remaining cable insulation through the cable receiving part into the shielding connection part;

(iv) laying the wires of the cable in corresponding guide structures 36 of the wire guide part 18; and (v) assembling the guide means 14 and the connection part 28 by screwing on the cap nut 12 overlapping the guide means 14, wherein the end region of the cable is clamped by means of the sealing 20 within the cable receiving part 16 and the wire insulations of the wires of the cable are cut through by the associated insulation displacement convectors 24 of the connection part 28 and the respective conductors of the wires are contacted.

The same applies particularly also to the conductor element 52 laid into one of the wire guide structures 36.

The following advantages are achieved:

a metal casing of the cable connection system 10 formed of a metallic cap nut 12, a metallic guide means 14 and a metallic connection part 28 is also suited for most severe industrial applications. Herein embodiments made of metal die casting up to high-grade steal are contemplated.

By using a metal thread at the cap nut 12 and the connection part 28 a high axial force for the wiring and the cable sealing within the cable receiving part 16 can be applied.

The one-piece structure of the guide means 14 and the one-piece cable guide and wire receiving part ensures a practical handling. Particularly for in situ assembly "in the field" no component parts can get lost.

The preparation of a shielded line can particularly easily and safely be managed in practice and requires no special precision.

LIST OF REFERENCE SYMBOLS

10 cable connection system
12 cap nut
14 guide means
16 cable receiving part
18 wire guide part
20 sealing
22 connection element
24 insulation displacement connector
26 connection body
28 connection part
30 male thread
32 connection region
34 shielding connection part
36 wire guide structure
38 longitudinal axis
40 catch means
42 base
44 spring element
46 end
48 opening
50 opening
52 conductor element
54 fin
56 recess

The invention claimed is:

1. A cable connection system including a cable connection plug, the cable connection system comprising:

a connection part comprising at least one connection element and at least one insulation displacement connector;

a cap nut adapted to be screwed onto the connection part; and a guide device that engages the connection part, wherein the guide device comprises:

a cable receiving part for receiving and clamping an end region of a cable having a wire; and a wire guide part for guiding the wire via at least one wire guide structure;

wherein, when the cap nut is situated over the guide device and screwed onto the connection part, an end region of the cable is clamped within the cable receiving part and a wire insulation of the wire, guided in by the guide device, is cut through by the insulation displacement connector;

wherein the guide device comprises a shielding connection part, disposed in a connection region between the cable receiving part and the wire guide part, wherein the shielding connection part receives and electrically contacts a shielding of the cable at an end region via at least one spring element, the shielding connection part comprising at least one conductor element, wherein, when the cable connection system is assembled, the conductor element extends through a wire guide structure and contacts an insulation displacement conductor associated with the wire guide structure.

2. The cable connection system according to claim 1, wherein the shielding connection part is electrically connected/connectable to a shielding element of the cable connection system.

3. The cable connection system according to claim 1, wherein the shielding connection part is formed as a funnel-like catch structure comprising an annular base and spring elements which extend obliquely from said base towards an axis of symmetry axis of the funnel structure.

4. The cable connection system according to claim 1, wherein the cable receiving part, the wire guide part, and the shielding connection part are connected to each other via a catch mechanism.

5. The cable connection system according to claim 1, wherein a shielding portion is formed or at least partially formed of the cap nut and a connection body of the connection part.

6. The cable connection system according to claim 1, wherein the cable connection system comprises the connection part.

7. A method of connecting a cable including shielding and at least one wire to a cable connection system according to claim 1, wherein the method comprises:

pulling the shielding in an end region of the cable over cable insulation of the cable;

inserting the wire up to a stop of the cable insulation through the cable receiving part into the shielding connection part;

laying the wire into the guide structure; and assembling the guide device and the connection element by screwing on the cap nut which extends over the guide device, wherein the end region of the cable is clamped within the cable receiving part and the wire insulation of the at least one wire is cut through by an associated insulation displacement connector of the connection element and the conductor of the wire is contacted;

wherein a conductor element of the shielding connection part is laid into a guide structure and electrically contacts an associated insulation displacement connector after the assembly of the guide device and the connection element.

8. The cable connection system according to claim 3, wherein a first opening of the catch structure has a first diameter at its base which is larger than a second diameter of a second opening of the catch structure at an opposite end.

9. The cable connection system according to claim 3, wherein the spring elements at an end opposite to a base comprise an outwardly angled end region.

* * * * *